United States Patent [19]

Perreten

[11] 4,102,100

[45] Jul. 25, 1978

[54] BUILDING WITH EXTERNAL PROVISION OF SERVICES

[75] Inventor: Roger Perreten, Veyrier, Switzerland

[73] Assignee: Etablissement d'Etudes et de Recherches Architecturales E.R.A., Geneva, Switzerland

[21] Appl. No.: 764,684

[22] Filed: Feb. 1, 1977

[30] Foreign Application Priority Data

Feb. 20, 1976 [CH] Switzerland ..... 2070/76

[51] Int. Cl.[2] ..... E04B 5/43

[52] U.S. Cl. ..... 52/227; 52/236.3; 52/236.9; 52/396; 52/573

[58] Field of Search ..... 52/723, 283, 236.3, 52/236.9, 261, 259, 167, 185, 573, 396, 227

[56] References Cited

U.S. PATENT DOCUMENTS

| | | | |
|---|---|---|---|
| 701,165 | 5/1902 | Doman | 52/723 |
| 1,039,951 | 10/1912 | Johnson | 52/437 |
| 2,057,601 | 10/1936 | Valenti | 52/723 |
| 2,270,846 | 1/1942 | Hines | 52/227 |
| 2,741,908 | 4/1956 | Swanson | 52/723 |
| 2,950,576 | 8/1960 | Rubenstein | 52/167 |
| 3,350,821 | 11/1967 | Jones | 52/167 |
| 3,520,096 | 7/1970 | Kilcher | 52/396 |
| 3,528,208 | 9/1970 | Sugawa | 52/396 |
| 3,538,659 | 10/1970 | McDermott | 52/167 |
| 3,757,477 | 9/1973 | McCrillis | 52/236.9 |
| 3,834,095 | 9/1974 | Ohlson | 52/259 |
| 3,879,914 | 4/1975 | Haller | 52/227 |

FOREIGN PATENT DOCUMENTS

| | | | |
|---|---|---|---|
| 905,425 | 12/1945 | France | 52/723 |
| 691,783 | 7/1930 | France | 52/593 |
| 813,371 | 5/1959 | United Kingdom | 52/259 |

*Primary Examiner*—John E. Murtagh
*Attorney, Agent, or Firm*—Young & Thompson

[57] ABSTRACT

The invention relates to a building comprising at least one monobloc supporting floor unit and external vertical wind-bracing structures serving for access, service areas and technical equipment, characterized by the fact that the floor unit comprises a plurality of prefabricated shaped concrete girders which are jointed and assembled side-by-side, and by the fact that this floor unit is connected to the external structures by at least one connection having a single degree of freedom and by at least one connection having two degrees of freedom, which absorb the dimensional variations in the floor unit transverse to the girders constituting said unit.

16 Claims, 16 Drawing Figures

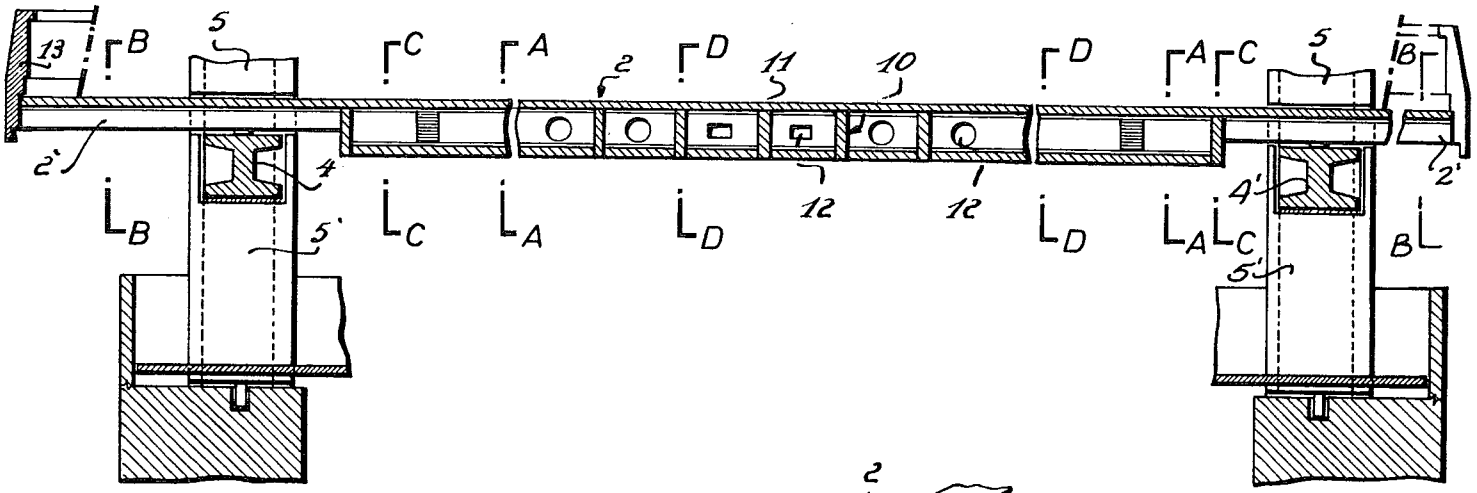
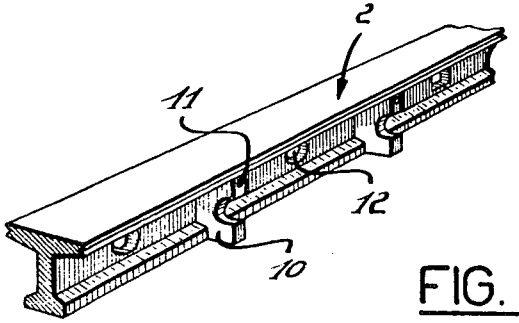
FIG. 3

34
33
35
37
29
36'
36
26
37
32
4

34
B
35
6
37
37
36'
26
36
C
C
32
31
1
B
26
37
32

41
42
40
37
43'
44
43
2C
38
39
4

42
B
41
37
37
6
44'
43'
44'
26
43
44
44
39
38
B

BUILDING WITH EXTERNAL PROVISION OF SERVICES

The present invention relates to a building having vertical external services comprising at least one monobloc supporting floor unit and external vertical wind-bracing structures serving for access, service areas and technical equipment.

When erecting buildings comprising a main body free from any vertical structure and not having any openings, and several secondary bodies external to the main body serving for access, service areas, technical equipment, etc. for example of the type described in the Swiss patent application No. 132.34 / 74, prefabricated monobloc floor units are required having a sufficient "lift" so that the bending is kept to a minimum, and which are able to be connected to the external wind-bracing structures so that the dimensional variations due to the expansion and/or contraction of the concrete are absorbed.

Thus, the building comprising the object of this invention is characterised by the fact that the floor unit comprises a plurality of prefabricated shaped concrete girders which are jointed and assembled side-by-side, and by the fact that this floor unit is connected to the external structures by at least one connection member having a single degree of freedom and by at least one connection member having two degrees of freedom, said connection members absorbing the dimensional variations in the floor unit transverse to the girders constituting it.

By "single degree of freedom" is meant, as will appear subsequently, the possibility of relative sliding movement between the floor unit and the external structure in only one orthogonal direction, this one direction being vertical. By "two degrees of freedom" is meant the possibility of relative sliding movement between the floor unit and the external structure in only two orthogonal directions, one of these being vertical and the other horizontal.

One embodiment of the building according to the invention will be illustrated diagrammatically and by way of example in the accompanying drawings, in which:

FIG. 2 is a partial view of a vertical section.

FIG. 3 is a perspective view of one of the shaped girders forming the floor unit.

FIGS. 4 A, B, C and D are sections along the lines AA, BB, CC and DD respectively of FIG. 2.

Figure 1:
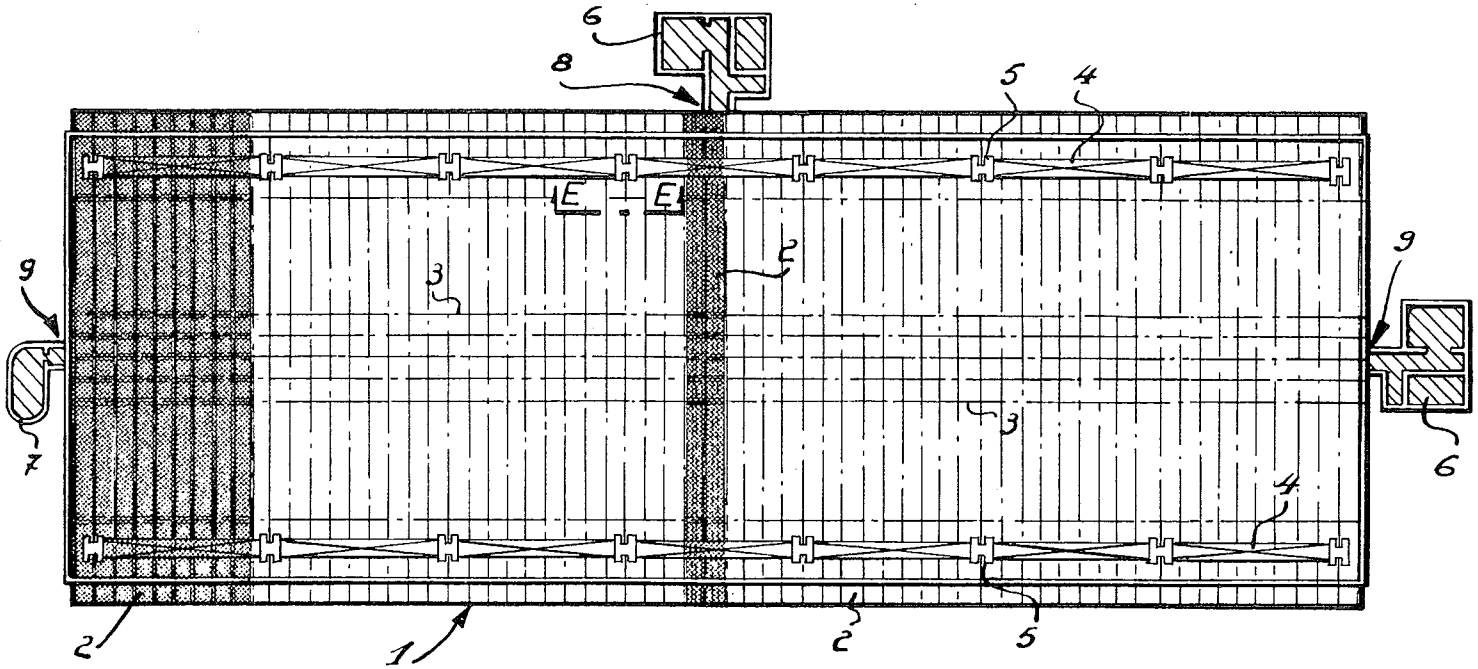
FIG. 1 is a plan view.
Figure 4A:
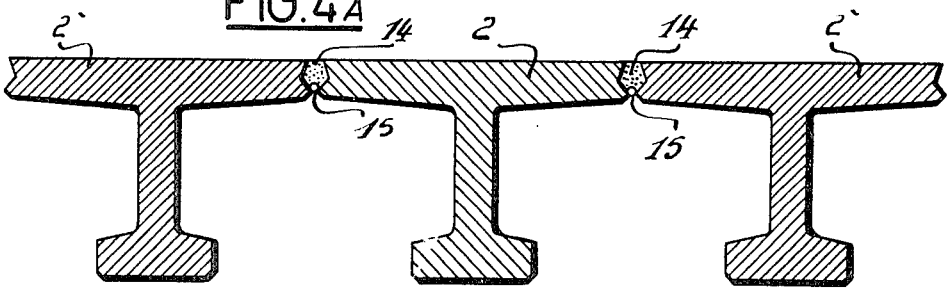
Figure 4B:
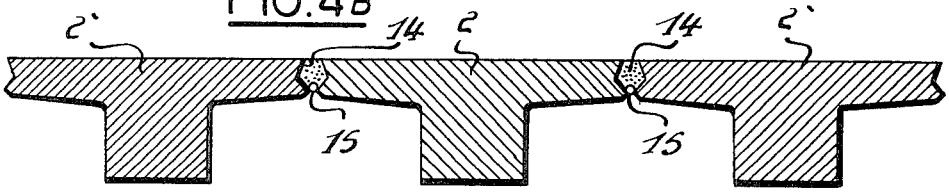
Figure 4C:
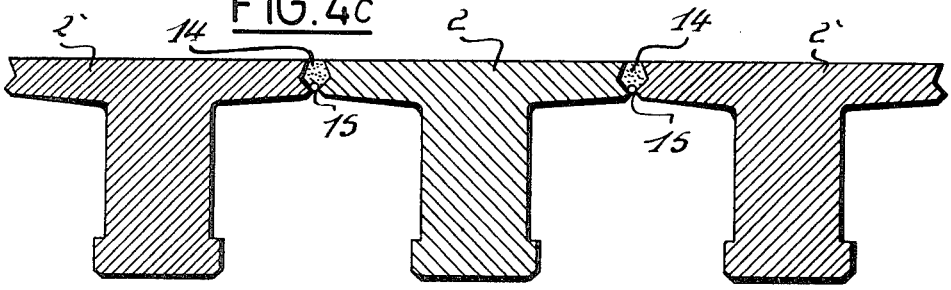
Figure 4D:
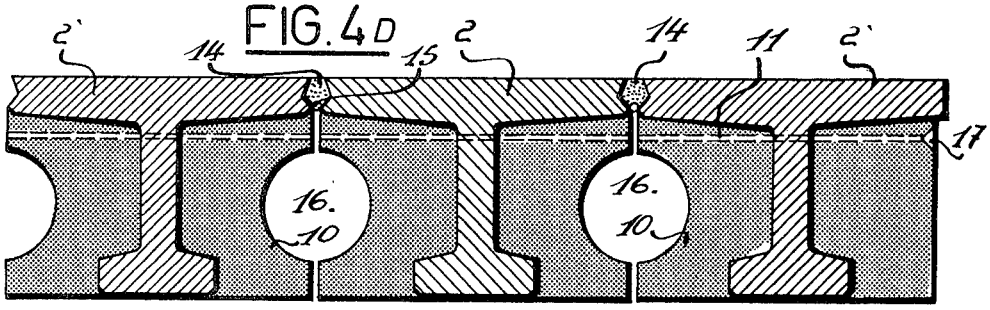
Figure 5:
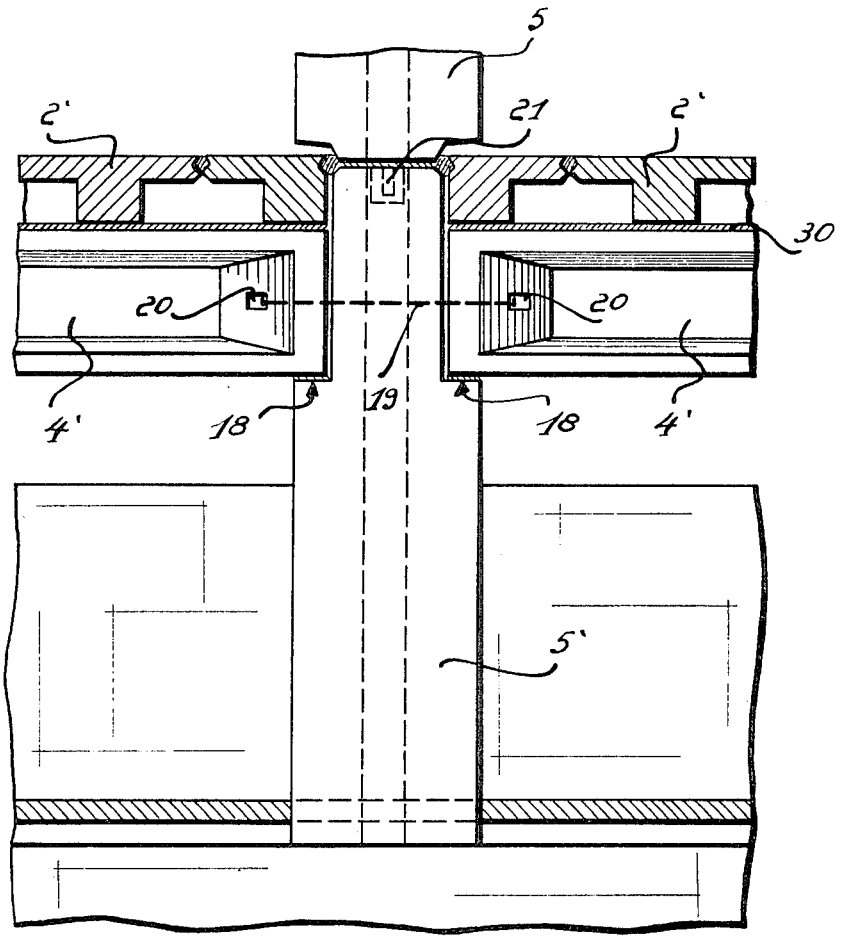

FIG. 5 is a sectional view along the line EE of FIG. 1, showing in detail the floor unit - post - cross beam connection.

Figure 6:
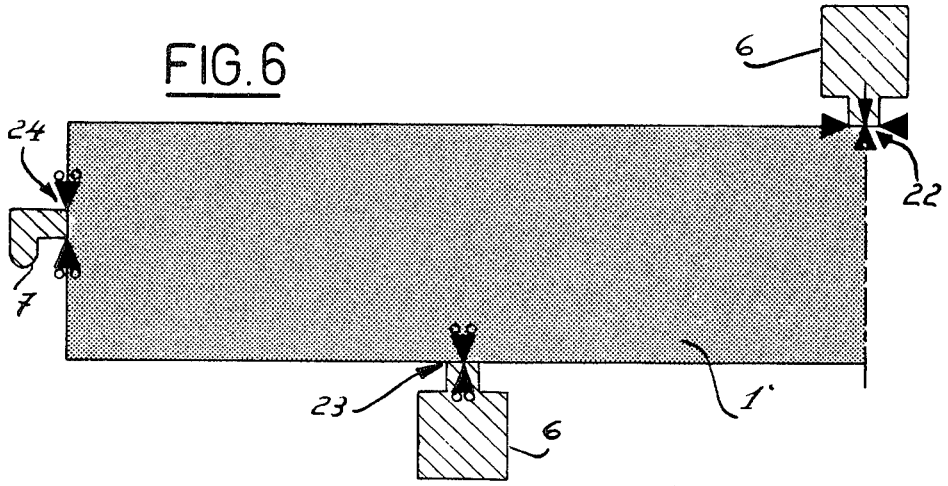

FIG. 6 is a schematic diagram of one embodiment of the floor unit — vertical wind-bracing structure connection.

Figure 7B:
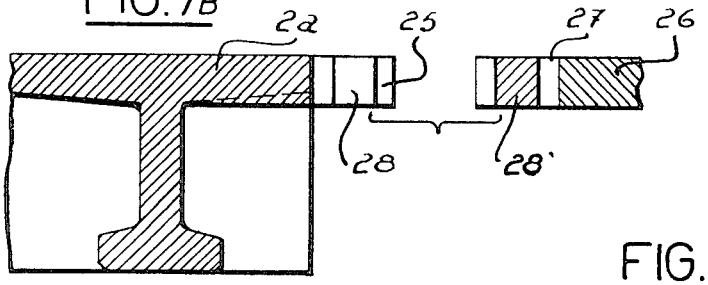
Figure 7A:
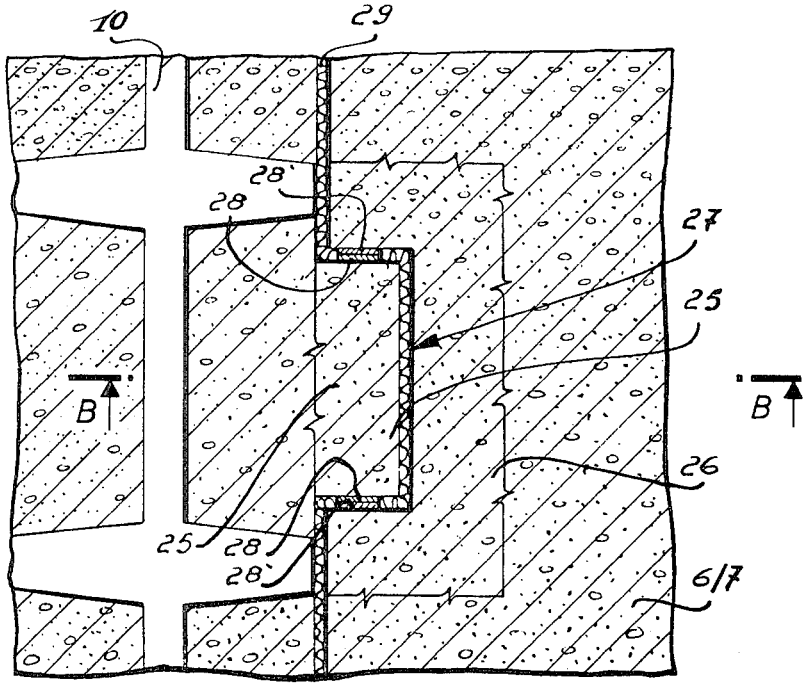

FIG. 7 A is a plan view of a first type of floor unit — vertical wind-bracing structure connection.

FIG. 7 B is an exploded sectional view along the line BB of FIG. 7 A.

Figures 8A, 8B, 8C:
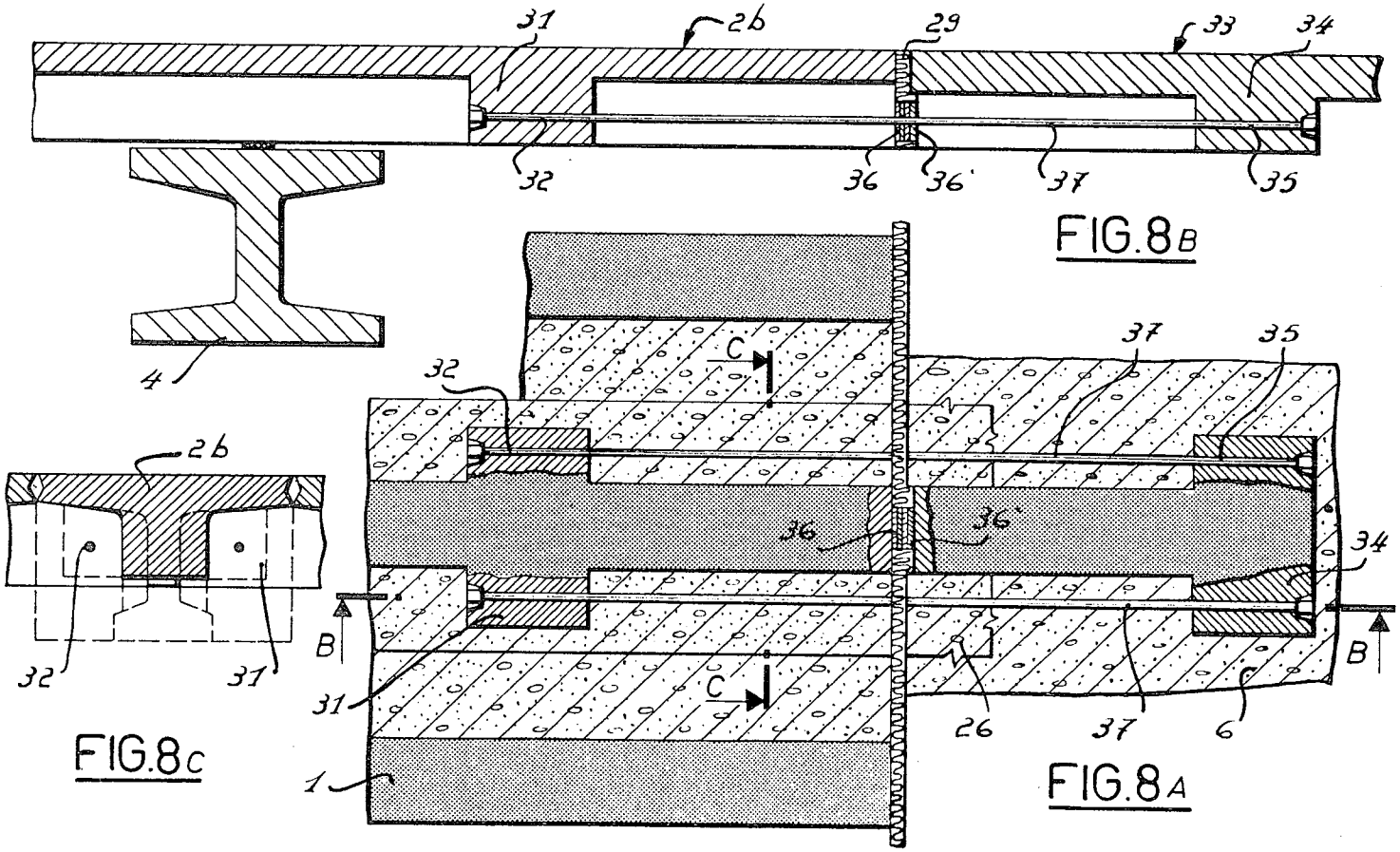

FIG. 8 A is a plan view of a second type of floor unit — wind-bracing structure connection.

FIGS. 8 B and 8 C are sectional views along the lines BB and CC respectively of FIG. 8 A.

Figures 9A, 9B:
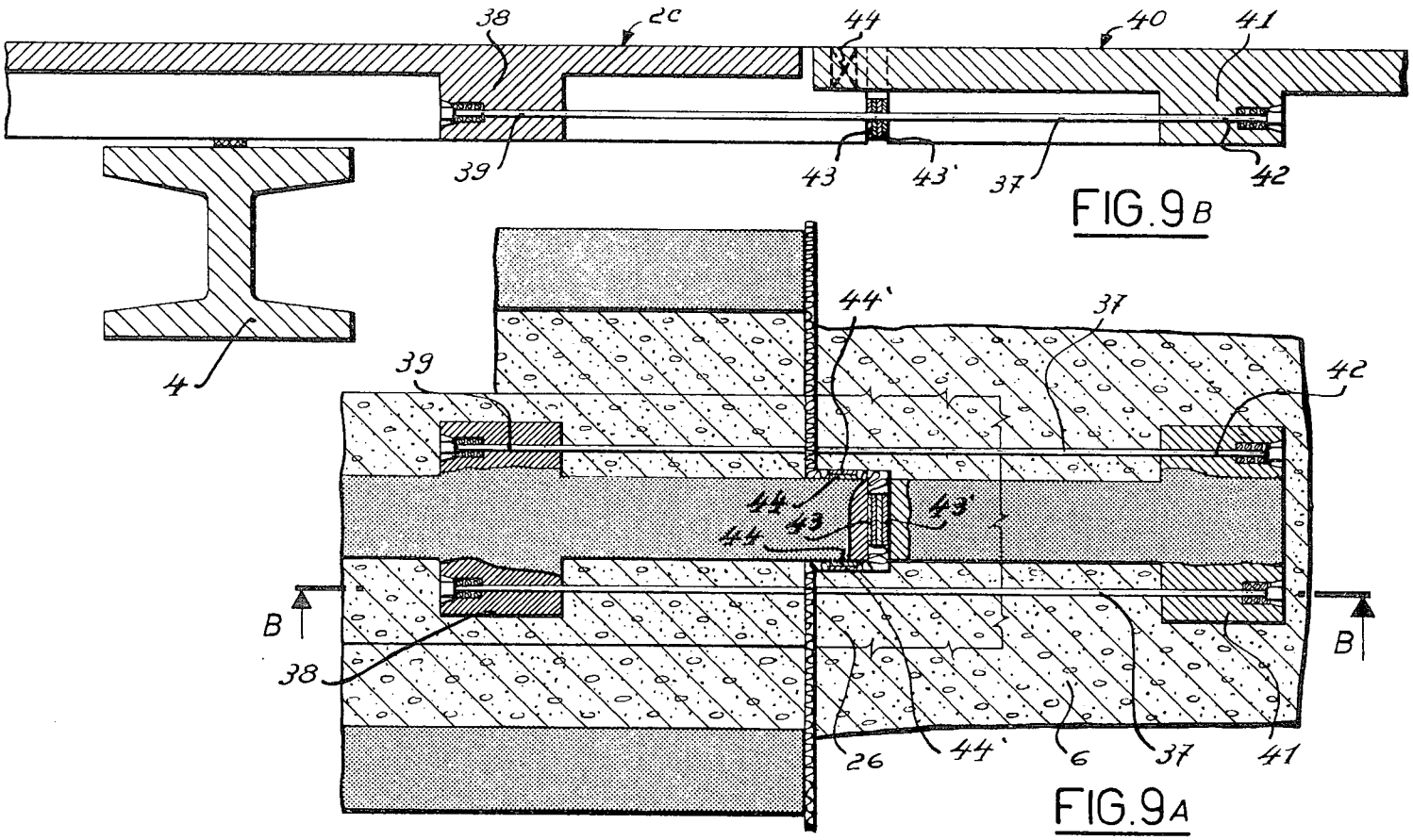

FIG. 9 A is a plan view of a third type of floor unit — wind-bracing structure connection.

FIG. 9 B is a sectional view along the line BB of FIG. 9 A.

As shown in FIG. 1, the monobloc floor unit 1 is formed by a plurality of prefabricated concrete shaped girders 2, assembled side-by-side and maintained thus by means of at least one transverse cable 3 passing through all the girders and held under tension at the ends; in this embodiment, five parallel cables define a central zone which is able to support extra loads, for example a main passageway, and thereby prevent any risk of bending or sagging.

The girders 2 forming the floor unit 1 are laid on cross beams which are themselves placed on and secured between vertical separation posts; in FIG. 1 the cross beams 4 and the posts 5 shown are those intended to take the floor unit directly above the floor unit 1.

The wind-bracing of the main structure formed by the superposition of monobloc supporting floor units is provided by external vertical structures shown here by two cores 6 and by an emergency staircase well 7, each core 6 comprising for example a lift shaft and a staircase well, these external structures also containing all the technical equipment, for example the different conduits for water, gas, electricity, the sewage pipes, the rubbish-chutes, etc. In this embodiment, the connections between the floor unit and the vertical wind-bracing structures comprise on the one hand a connection member 8 having a single degree of freedom, and on the other hand two connection members 9 having two degrees of freedom. The degree of freedom always present is that in the direction along a vertical axis, the second degree of freedom in this context being that in the direction perpendicular to the axis of the girders 2, thereby enabling dimensional variations in the floor unit due to expansion and/or contraction of the concrete to be absorbed. The connection with a single degree of freedom is always situated on the face of the floor unit 1 perpendicular to the girders 2, whereas the connections having two degrees of freedom may be situated on the faces of the floor unit 1 perpendicular and/or parallel to the girders 2. These connections will be described in detail hereinafter.

The sectional and perspective detail of a shaped girder 2 is shown in FIGS. 2 and 3 respectively. As shown in these Figures, each shaped section 2, prefabricated in one piece from concrete, has transverse ribs 10, some of which are pierced by holes 11 to permit the passage of assembly cables 3. Furthermore, the shaped sections 2 are pierced by circular, rectangular, or suitably shaped transverse passages 12 intended to receive the various systems of pipes supplying each floor horizontally.

The final portions 2' of each shaped section 2 are intended to be placed on cross beams consisting in this case of shaped sections 4' perpendicular to the axis of the said shaped sections 2, the cross beams 4' being placed on and secured to the upper part of the posts 5', as will be shown in detail with reference to FIG. 5. Furthermore, the end of the portions 2' of the girders 2 may be provided with elements 13 defining for example a balcony, the vertical walls of the main body of the building being disposed internally of the posts 5, 5'.

From the sections shown in FIGS. 4 A to 4 D, it can be seen that the shape of the profiled girder 2 varies along its longitudinal axis. The side-by-side assembly of the shaped sections 2 is ensured on the surface by joints 14, of cast concrete for example, a caulking strip 15 being placed at the bottom of the groove formed between the shaped sections so as to retain the concrete, cast during the jointing process, in this groove.

In the functioning position, as shown in FIG. 4 D, the transverse ribs 10 of the adjacent shaped sections 2 rest against one another so as to form transverse reinforcements over the whole length of the floor unit 1, thereby reducing the risks of bending. In addition, longitudinal passages 16 for systems of piping are also obtained by assembling the transverse ribs as shown also in FIG. 4 D.

In the same FIG. 4 D, the transverse shaft 11 for the passage of the cables 3 is shown by dotted lines, the end 17 of this shaft comprising means (not shown) for tightening and securing the said cables 3.

FIG. 5 shows the outline detail of the cross beam-post connection. The shaped sections 4' constituting the cross beams are placed on shoulder members 18 of the lower post 5'; the two shaped sections 4' are maintained on each side of the post 5' by means of a cable 19 passing through openings 20 made in the ends of the said shaped sections 4' and through the said post 5'. It is then possible to place transversely the portions 2' of the girders 2 on the cross beams thus formed, while interposing a neoprene strip 30, so as to constitute the floor unit 1. Then, with a view to forming the upper floor, it is expedient to add to the posts 5', and as an extension thereof, posts 5 whose lower end is provided with a pin 21 cooperating with a corresponding opening in the upper end of the lower post 5', and then to place between the upper posts 5 new cross beams 4 intended to receive the upper floor unit.

The schematic diagram of FIG. 6 shows one way of connecting the floor unit 1' to the external wind-bracing structures 6, 7, different from that of FIG. 1, and which comprises a connection having a single degree of freedom at 22, that is to say on the face of the floor unit 1' perpendicular to the girders and closest to the centre of expansion, this floor unit 1' being extended to the right of the Figure according to the vertical chain-dot line, and two connections having two degrees of freedom 23, 24. The first connection 23 is situated on the face of the floor unit 1' perpendicular to the girders and opposite that face containing the connection having a single degree of freedom, whereas the second connection 24 is situated in the centre of the face of the floor unit 1' parallel to the girders.

Of course, the floor unit — external wind-bracing structure connections may be situated in accordance with other embodiments (not shown), but on the condition that there is at least one connection having a single degree of freedom on one longitudinal face of the floor unit, and at least one connection having two degrees of freedom. When making these connections in practice, it will of course be expedient in each case to carry out a comprehensive calculation of the wind-bracing in order to determine the respective positions of these connections having a single degree of freedom and two degrees of freedom, and, furthermore, the size of the foundations will also be calculated from case to case depending on the nature of the terrain and the operative constraints.

One example of embodiment of each of the types of floor unit - vertical wind-bracing structures will now be described with reference to FIGS. 7 to 9.

The first type of connection, shown in FIGS. 7 A and 7 B, is one having one degree of freedom between a lateral face of the floor unit 1 and a vertical wind-bracing structure, namely a core 6 or a simple staircase well 7. In this first type, the end shaped section 2a is provided, by concreting in a factory for example, with a projecting part 25 intended to co-operate in the functioning position, as is shown in FIG. 7 A, with a corresponding clamp member 27 provided with the keying zone 26 for the wind-bracing structure 6/7. Furthermore, the lateral walls of the projecting member 25 and the internal lateral walls of the clamp member are each provided with a contact member 28, 28' respectively, consisting of a steel plate coated with teflon, these contact elements 28, 28' being intended to ensure that the projecting member 25 can slide in the clamp when there are variations due to the contraction or expansion of the concrete, this sliding being in the direction perpendicular to the axis of the shaped sections 2. Finally, a sagex layer 29 is interposed, in particular as an insulation medium, between the floor unit and the wind-bracing structure.

The second type of connection, shown in FIGS. 8 A to 8 C, is a connection having two degrees of freedom between a longitudinal face of the floor unit 1 and a vertical wind-bracing structure, more especially a core 6. The connecting shaped section 2b contains two additional transverse ribs 31 in its end part, each being pierced by an orifice 32, while the wind-bracing structure comprises a connecting shaped section 33 also provided with two transverse ribs 34 pierced by passages 35.

As shown in FIGS. 8 A and 8 B, the connecting shaped sections 2b and 33 respectively are disposed opposite one another at their ends, the latter furthermore previously being provided with a contact element 36, 36' consisting of a steel plate coated with neoprene and teflon. The securement of these shaped sections 2b and 33 to one another is ensured by two cables 37 passing through the orifices 31 and 35, and which are tensioned and clamped at their ends. As previously, a sagex layer 29 is interposed between the floor unit 1 and the structure 6. With this embodiment of floor unit — vertical wind-bracing structure connection, movements in both directions perpendicular to the axis of the shaped sections 2 due to the contraction or expansion of the concrete are possible, while the relative displacement of the floor unit 1 with respect to the structure 6 in the direction parallel to this axis is stopped.

Finally, the third type of connection shown in FIGS. 9 A and 9 B is a connection having a single degree of freedom between a longitudinal face of the floor unit 1 and a vertical wind-bracing structure, more especially a core 6, this connection being to some extent a combination of the two previously described types. In actual fact, the end part of the connecting shaped section 2c comprises two additional transverse ribs 38 each pierced by an orifice 39, while the wind-bracing structure comprises a connecting shaped section 40 also provided with two transverse ribs 41 pierced by passages 42, and the lower ends of these two connection shaped sections 2c and 40 are each provided with a contact element 43, 43' comprising a steel plate coated with neoprene and teflon. In addition, the end of the connection shaped section 2c projects with respect to the longitudinal face of the floor unit 1, and cooperates in the functioning position with a clamp which is provided in the keying zone for the structure 6, the internal side walls of this clamp and also the corresponding side walls of the connection shaped section 2c each being provided with a contact element 44, 44' comprising a steel plate coated with teflon.

In the functioning position, the two connection shaped sections 2c and 40 are secured to one another by two cables 37 passing through the holes 35 and 42, tensioned and secured at their ends, and the projecting part of the connection shaped section 2c co-operates with the clamp of the structure 6; thus, any relative movement of the floor unit 1 with respect to the external wind-bracing structure 6 is prevented, the connection consequently having only a single degree of freedom, namely along a vertical axis.

Among the main advantages presented by the building according to the invention, there may be mentioned: - the high flexibility of adaptation to different designs of buildings by virtue of the use of monobloc supporting floor units connected to external vertical wind-bracing structures; and - the speed and ease of construction in situ from factorymade prefabricated concrete girders.

What we claim is:

1. A building comprising at least one monobloc supporting floor unit and external vertical wind-bracing structures serving for access, service areas and technical equipment, the floor unit comprising a plurality of prefabricated shaped concrete girders which are jointed and assembled side by side, a first connection interconnecting said floor unit and one of said external structures on one side of said building for relative sliding movement only in a vertical direction, and a second connection interconnecting said floor unit with another of said external structures on a different side of said building for relative sliding movement only in a vertical direction and in one horizontal direction, thereby to absorb the dimensional variations in the floor unit transverse to the girders constituting said unit.

2. A building according to claim 16, characterized by the fact that there are at least three said external structures that slidably bear against at least three different sides of said building, only one of said structures being slidably interconnected with said floor unit for relative movement only in a vertical direction, at least two others of said external structures being slidably interconnected with said floor unit for relative movement only in a vertical direction and in one horizontal direction.

3. A building according to claim 1, characterised by the fact that each girder comprises transverse ribs which, in the functioning position, bear against the corresponding ribs of adjacent girders so as to form continuous transverse reinforcements over the whole length of the floor unit.

4. A building according to claim 3, characterised by the fact that the girders are maintained in the assembled position by at least on cable passing through orifices made transversely in the girders, the said cable being tensioned and secured at the ends of the floor unit.

5. A building according to claim 4, characterised by the fact that the floor unit comprises several parallel cables disposed transversely to the girders and in at least one zone intended to take overloading.

6. A building according to claim 1, characterised by the fact that the girders also comprise transverse passages intended for pipe lines.

7. A building according to claim 3, characterised by the fact that the transverse ribs define, when resting against one another to form a functioning position, longitudinal passages for receiving pipe lines.

8. A building according to claim 1, characterised by the fact that it comprises several monobloc floor units on which are superimposed vertical posts between which are placed and secured shaped sections serving as cross beams for the girders of the floor unit, and disposed transversely with respect to the said girders.

9. A building according to claim 1, characterised by the fact that said first connection is situated on the face perpendicular to the girders of the floor unit.

10. A building according to claim 1, characterised by the fact that said second connection is situated on the face perpendicular and/or parallel to the girders of the floor unit, said horizontal direction being along an axis perpendicular to the girders.

11. A building according to claim 10, characterised by the fact that said second connection comprises a clamping member formed in the external wind-bracing structure and that receives a fabricated projection which is laterally provided in the end girder of the floor unit, so that relative movement of this floor unit with respect to the external structure is permitted along an axis perpendicular to the girders of said floor unit.

12. A building according to claim 11, characterised by the fact that the internal side walls of the clamp and the external side walls of the projection engaged with one another are provided with contact elements comprising a steel plated coated with polytetrafluoroethylene.

13. A building according to claim 10, characterised by the fact that said second connection comprises a connection shaped section integral with the external wind-bracing structure and engaged end-to-end with a connection girder of the floor unit, this shaped section and this girder each being provided with two transverse ribs each pierced by an orifice, and by the fact that the connection shaped section and the connection girder are maintained end-to-end by two cables passing through two oppositely disposed orifices and maintained under tension at their ends, so that relative movement of the floor unit with respect to the external structure is allowed along an axis perpendicular to the girders of the floor unit.

14. A building according to claim 13, characterised by the fact that the ends of the connection shaped section and the connection girder respectively, which engage with one another in the functioning position, are provided with contact elements comprising a steel plate coated with neoprene and polytetrafluoroethylene.

15. A building according to claim 9, characterised by the fact that said first connection comprises a connection shaped section integral with the external wind-bracing structure, one end of which is provided with a clamp that receives a longitudinal portion, projecting with respect to the end of the floor unit, of a connection girder of this floor unit, this shaped section and this girder each being provided with two transverse ribs each pierced by an orifice, and by the fact that the connection shaped section and the connection girder are maintained together, the projecting portion of the girder cooperating with the clamp of the shaped section, by two cables passing through two oppositely located orifices and maintained under tension at their ends, so that any relative movement of the floor unit with respect to the external structure, in a horizontal plane, is prevented.

16. A building according to claim 15, characterised by the fact that the internal side walls of the clamp and the external walls of the projecting portion are provided with contact elements comprising a steel plate coated with polytetrafluoroethylene, and by the fact that the end of the projecting portion as well as the internal wall of the clamp with which it is engaged are provided with contact elements comprising a steel plate coated with neoprene and polytetrafluoroethylene.

* * * * *